United States Patent [19]

DeLise

[11] 4,194,174

[45] Mar. 18, 1980

[54] METHOD FOR FABRICATING BALLASTED FINGER ELECTRODE

[75] Inventor: Michael F. DeLise, Doylestown, Pa.

[73] Assignee: Microwave Semiconductor Corp., Somerset, N.J.

[21] Appl. No.: 916,904

[22] Filed: Jun. 19, 1978

[51] Int. Cl.[2] ..... H01C 1/012

[52] U.S. Cl. ..... 338/308; 427/101; 427/103

[58] Field of Search ..... 338/308, 20; 357/68; 29/589, 590; 427/101, 102, 103

[56] References Cited

U.S. PATENT DOCUMENTS

| | | | |
|---|---|---|---|
| 3,225,261 | 12/1965 | Wolf | 357/28 X |
| 3,742,319 | 6/1973 | Bryan et al. | 357/68 X |
| 4,091,409 | 5/1978 | Wheatley, Jr. | 357/68 X |

*Primary Examiner*—C. L. Albritton

*Attorney, Agent, or Firm*—Pennie & Edmonds

[57] ABSTRACT

A ballasted finger electrode structure is fabricated on a substrate by the steps of depositing on the substrate a layer of resistive material, forming one or more dielectric regions on the resistive layer; and forming two or more finger electrode segments spaced apart over one or more of the dielectric regions but electrically connected by the resistive region underlying the dielectric region. The result is a finger electrode structure with a precisely defined length of resistive ballasting.

6 Claims, 7 Drawing Figures

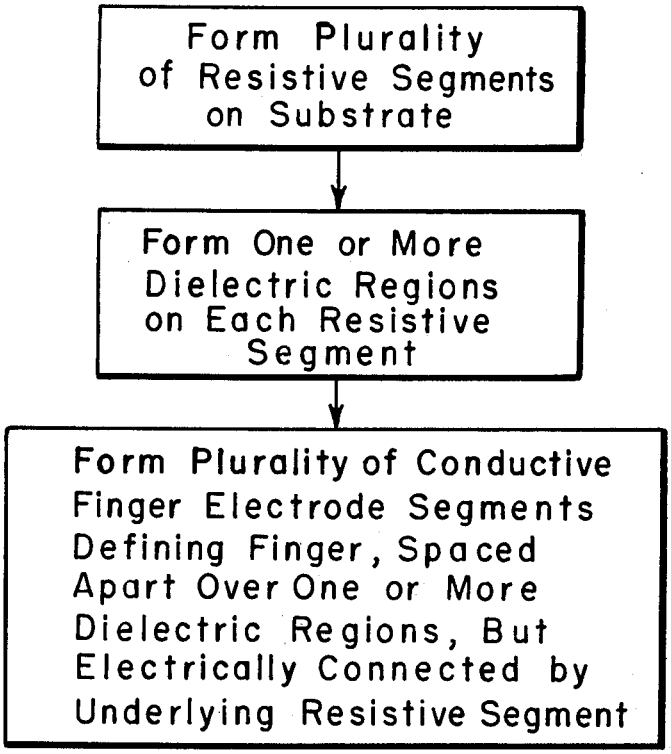
FIG. 1
FIG. 2A
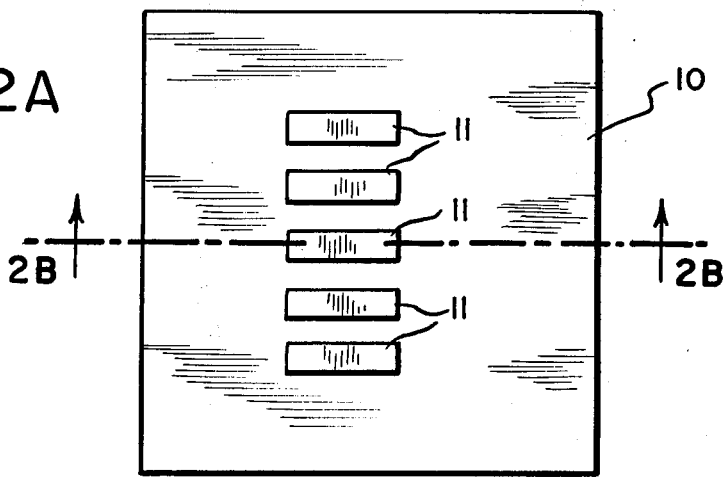
FIG. 2B
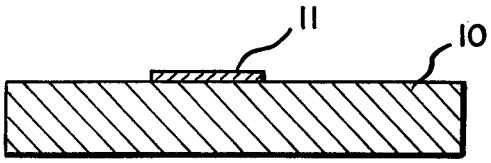

FIG. 3A
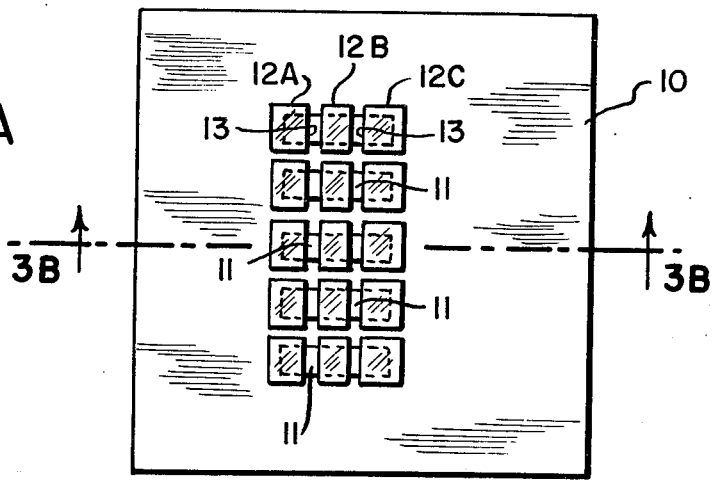
FIG. 3B
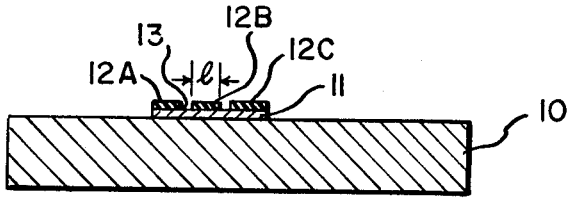
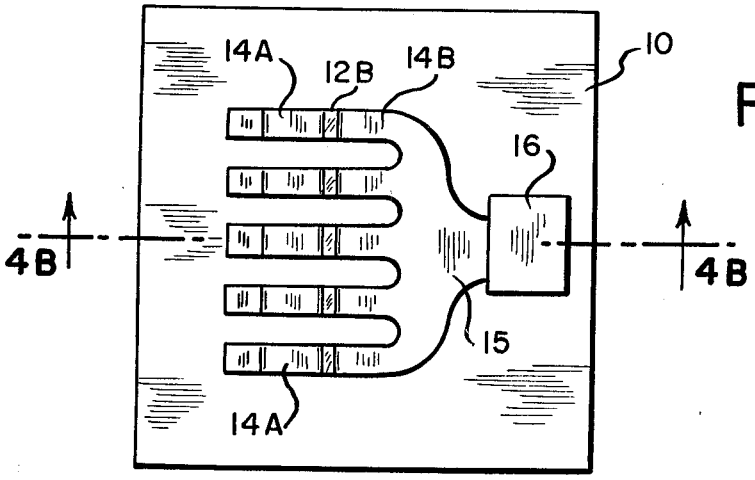
FIG. 4A
FIG. 4B
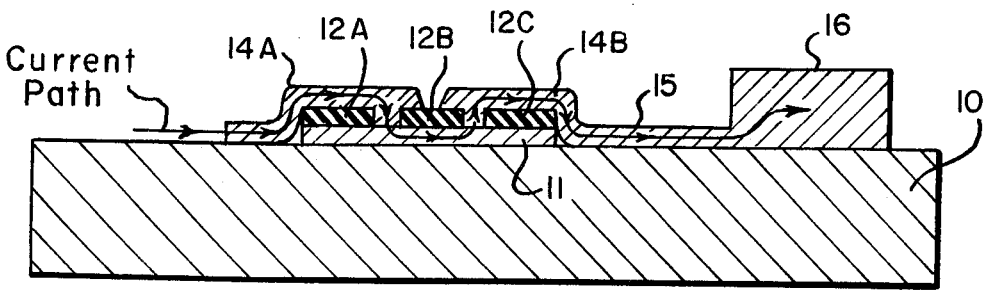

METHOD FOR FABRICATING BALLASTED FINGER ELECTRODE

BACKGROUND OF THE INVENTION

1. Field Of The Invention

The present invention relates to a method for fabricating ballasted finger electrodes.

2. History Of The Art

Finger electrodes comprising a plurality of long, narrow conductive elements extending generally transversely from a common conductive connecting element are used in a variety of electronic devices including microwave and ultrasonic devices. Such electrodes are used, for example, in overlay-type microwave power transistors. Such transistors typically utilize an emitter metallization pattern comprising finger electrode structure with the common connecting element connected to a bonding pad at one side of a base pocket and a plurality of thin, narrow, elongated "fingers" extending across successive rows of emitter sites formed in the base pockets. The base metallization pattern can also comprise a second finger electrode structure interleaved with the first and connected to a bonding pad on the opposite side of the base pocket.

Because the thickness and width of individual fingers are very small, the cross-sectional area is difficult to control with high precision. As a result, there can be substantial variation of electrical resistance from one finger to another.

In order to minimize variations in resistance from one finger to another, the fingers are usually "ballasted" by providing resistive regions in each finger. Such regions act as dominant series resistances and substantially reduce the percentage variation in resistance among the fingers. The usual method of fabricating ballasted finger electrodes on a semiconductor device involves disposing thin resistive layers on the device, depositing the electrode metal on the resistive layer, and etching the metal to define each finger electrode as two or more spaced apart conductive segments interconnected by an underlying resistive layer.

The difficulty with this approach is that the etching process tends to undercut the metal in a manner which is essentially uncontrollable with the result that the spacing between electrodes, and hence the length of the resistive path, is difficult to control. Accordingly, there is a need for a more accurate and more controllable process for fabricating ballasted finger electrodes.

SUMMARY OF THE INVENTION

In accordance with the present invention, a ballasted finger electrode structure is fabricated on a substrate by the steps of depositing on the substrate a layer of resistive material, forming one or more dielectric regions on the resistive layer; and forming two or more finger electrode segments spaced apart over one or more of the dielectric regions but electrically connected by the resistive region underlying the dielectric region. The result is a finger electrode structure with a precisely defined length of resistive ballasting.

BRIEF DESCRIPTION OF THE DRAWINGS

The nature, advantages, and various additional features of the invention will appear more fully upon consideration of the illustrative embodiments now to be described in detail in connection with the accompanying drawings.

In the drawings:

FIG. 1 is a flow diagram illustrating the steps involved in fabricating a ballasted finger electrode in accordance with a preferred embodiment of the invention.

FIGS. 2A and 2B are top and cross-sectional views showing a semiconductor substrate at an early stage of the process.

FIGS. 3A and 3B are top and cross-sectional views showing the substrate at an intermediate stage of the process.

FIGS. 4A and 4B show the substrate after the final stage of the process.

For convenience of reference, the same reference numerals designate the same structural elements throughout the drawings.

DETAILED DESCRIPTION OF THE DRAWINGS

Referring to the drawings, FIG. 1 is a flow diagram of a preferred method for fabricating a ballasted finger electrode structure in accordance with a preferred embodiment of the invention. As illustrated, the first step involves forming on a substrate 10 of FIGS. 2A and 2B, such as a semiconductor chip, one or more resistive segments 11, each segment positioned to underlie at least a portion of a respective desired finger electrode. This step can be effectuated by depositing a thin film of resistive material such as a film of tantalum, nichrome, or polysilicon having a thickness on the order of 0.1 to 1.0 microns. Deposition can be effected by conventional techniques such as vacuum evaporation, by sputtering or, in the latter case, by vapor deposition. The resistive layer is then selectively etched away by conventional photoetching techniques to leave segments 11.

The next step involves forming one or more dielectric regions on each of the resistive segments. This can be effected, for example, by silane deposition of a layer of silicon dioxide on the resistive layer and surrounding substrate, and a subsequent photoetching to preferably produce a plurality of three spaced apart dielectric regions 12A, 12B, and 12C of FIGS. 3A and 3B, on each resistive segment. The dielectric preferably has a thickness on the order of 0.5 to 1.5 microns, and the length of the intermediate dielectric region 12B is chosen to control the length, l, of the resistive path to be included in each finger electrode. Typically, l will be on the order of 1 to 10 mils. Spaces 13 are typically on the order of 0.1 to 1.0 mils so that a subsequently applied conductive layer will contact the resisitive layer at a well-defined localized region. In the limiting case, regions 12A and 12C can be dispensed with, permitting wide area contact between conductive finger portions and the resistive segment on either side of region 12B.

The final step involves forming a plurality of conductive finger electrode segments 14A and 14B of FIGS. 4A and 4B defining each finger of a finger electrode structure. The segments of each finger are spaced apart in a region overlying one or more dielectric regions, such as intermediate regions 12B, but electrically connected by the underlying resistive layer 11. This can be effected by depositing on the substrate an overall layer of conductive metal such as a layer of gold or aluminum 1.0 to 5.0 microns thick, masking the metal to define the electrode finger segments 14A and 14B and connecting element 15; then etching away the unmasked metal. A thicker bonding pad 16 for contacting the common element can be subsequently applied.

The invention can be further understood by reference to the following specific example. A resistive layer comprising 5,000 angstroms of polysilicon is deposited by vapor deposition on a silicon transistor wafer prepared for metallization. A plurality of resistive segments are formed from the resistive layer by conventional photo-resist etching. A dielectric layer comprising 5,000 angstroms of silicon dioxide is deposited on the resulting substrate by silane deposition, and contacts to the device and to the polysilicon segments are defined by photoetching through the silicon dioxide. Platinum-silicide ohmic contacts to the device and the polysilicon segments are formed in the conventional manner, and the finger electrode conductors are formed by depositing a 15,000 angstrom layer of aluminum by vacuum evaporation and photoetching.

The advantage of this structure is that the lengths of the dielectric regions, which define the resistive path, can be controlled to a much higher degree of precision than can be the spacing between conductive segments. The result is precise control over the length of resistive path introduced into each finger.

While the invention has been described in connection with a small number of specific embodiments, it is to be understood that these are merely illustrative of the many other specific embodiments which can also utilize the principles of the invention. Thus, numerous and varied devices can be made by those skilled in the art without departing from the spirit and scope of the invention.

I claim:

1. A method of fabricating a ballasted finger electrode on a substrate comprising the steps of:

forming on such substrate at least one resistive segment at a position for underlying at least one finger electrode;

forming at least one dielectric region on said resistive segment; and forming a plurality of conductive segments defining a finger electrode, said segments being spaced apart in a region overlying at least one of said dielectric regions and electrically connected through said resistive segment underlying said dielectric region.

2. The method according to claim 1 wherein, at least three spaced apart dielectric regions are formed on said segment, the spaces between said dielectric regions defining contact regions on either side of at least one said dielectric region;

and the step of forming a plurality of conductive segments defining a finger electrode comprises forming conductive segments disposed in electrical contact with said resistive segment through said respective contact regions.

3. A method of fabricating a ballasted finger electrode structure on a substrate comprising the steps of:

forming on such substrate a plurality of resistive segments at positions for underlying the fingers of said finger electrode structure;

forming on each said resistive segment at least one dielectric region; and forming a plurality of conductive finger electrode segments defining each finger of said finger electrode structure, the segments of each finger being spaced apart in a region overlying at least one dielectric region but electrically connected through said underlying resistive segments.

4. The method according to claim 3 wherein at least three spaced apart dielectric regions are formed on each segment defining contact regions on either side of at least one said dielectric region.

5. The method according to claim 4 wherein the step of forming a plurality of conductive finger electrode segments comprises forming for each conductive finger, conductive segments disposed in electrical contact with respective resistive segments through said respective contact regions.

6. A ballasted finger electrode structure of the type comprising a plurality of finger electrodes including respective resistive portions disposed upon a substrate, the improvement wherein at least one of said finger electrodes comprises a plurality of conductive segments spaced apart in a region overlying a dielectric region and electrically connected through a resistive segment underlying said dielectric region.

* * * * *